US009035551B2

(12) United States Patent
Miyamoto et al.

(10) Patent No.: US 9,035,551 B2
(45) Date of Patent: May 19, 2015

(54) COAXIAL MAGNETRON

(71) Applicant: New Japan Radio Co., Ltd., Tokyo (JP)

(72) Inventors: Hiroyuki Miyamoto, Fujimino (JP); Hideyuki Obata, Fujimino (JP); Akinori Umeda, Fujimino (JP)

(73) Assignee: NEW JAPAN RADIO, LTD (JP)

( * ) Notice: Subject to any disclaimer, the term of this patent is extended or adjusted under 35 U.S.C. 154(b) by 0 days.

(21) Appl. No.: 14/055,693

(22) Filed: Oct. 16, 2013

(65) Prior Publication Data

US 2014/0191657 A1 Jul. 10, 2014

(30) Foreign Application Priority Data

Jan. 7, 2013 (JP) ..... 2013-000512

(51) Int. Cl.

| | |
|---|---|
| ***H01J 23/00*** | (2006.01) |
| ***H01J 23/20*** | (2006.01) |
| ***H01J 25/587*** | (2006.01) |
| ***H01J 23/12*** | (2006.01) |

(52) U.S. Cl.

CPC ..... *H01J 23/005* (2013.01); *H01J 23/20* (2013.01); *H01J 25/587* (2013.01); *H01J 23/12* (2013.01)

(58) Field of Classification Search

CPC ..... H01J 23/005
USPC ..... 315/39.75
See application file for complete search history.

(56) References Cited

U.S. PATENT DOCUMENTS

| | | | | |
|---|---|---|---|---|
| 3,297,905 | A | 1/1967 | Fiedor et al. | |
| 3,383,551 | A | 5/1968 | Gerard | |
| 3,440,565 | A | 4/1969 | Scullin et al. | |
| 3,984,725 | A | 10/1976 | Cook et al. | |
| 4,053,850 | A | 10/1977 | Farney et al. | |
| 4,636,749 | A * | 1/1987 | Thornber | 331/90 |

FOREIGN PATENT DOCUMENTS

| | | |
|---|---|---|
| GB | 611505 | 11/1944 |
| JP | 10269953 | 10/1998 |
| JP | 10302655 | 11/1998 |
| JP | 2004134160 | 4/2004 |

* cited by examiner

*Primary Examiner* — Tuyet Vo
(74) *Attorney, Agent, or Firm* — Perman & Green, LLP

(57) ABSTRACT

The object of the presently disclosed embodiment is to improve heat dissipation and an overall cooling efficiency to raise a peak oscillation output. To achieve the object, there is provided a coaxial magnetron having the following configuration: Around a cathode, vanes and an anode cylinder form an anode resonant cavity, and a cylindrical side body forms an outer cavity. An input side structure having an input part and an upper structure are joined to both ends of the cylindrical side body. One end of the anode cylinder is joined to the input side structure. A groove (or step) for adjusting the distance between the structures and at the both ends is provided, and the groove is joined to the other end of the anode cylinder.

8 Claims, 6 Drawing Sheets

--PRIOR ART--

COAXIAL MAGNETRON

CROSS-REFERENCE TO RELATED APPLICATIONS

This application claims priority to and the benefit of Japanese Application No. 2013-000512 filed on 7 Jan. 2013, the disclosure of which is incorporated by reference in its entirety.

BACKGROUND

The presently disclosed embodiment relates to magnetrons that oscillate microwaves, and particularly to a structure of coaxial magnetrons having an outer cavity outside an anode resonant cavity.

Since magnetrons can oscillate high-power microwaves efficiently in a simple configuration, they have been used in a variety of applications and devices. Among those, examples of devices in which an oscillation frequency needs to be tuned precisely include radars that execute detection by changing a frequency precisely to avoid interference and Linac that puts precisely-tuned microwaves into a narrow band resonator with a high Q factor to apply an accelerating electric field to an electron. Magnetrons used in such applications and devices need to have a mechanism that can mechanically change frequencies. Coaxial magnetrons are put into practical use as one option.

FIG. 6 shows an example of a coaxial magnetron in which high-power microwaves are obtained. As shown in FIG. 6, around a cathode 1 disposed centrally, vanes 2 radially disposed and an anode cylinder 3 to which the vanes 2 are joined as an anode are provided, and the vanes 2 and the anode cylinder 3 form an anode resonant cavity 50. A slot 4 is provided in the anode cylinder 3 and a cylindrical side body 6 is disposed around the anode cylinder 3, thereby forming an outer cavity 60 coaxial with the anode resonant cavity 50. Furthermore, pole pieces 7*a* and 7*b* are disposed above and below the cathode 1, a tuning piston 8 is provided in the outer cavity 60, and a cooling passage 11 for running a coolant therethrough is provided in an input side structure 14 to be joined to an input part 9.

The pole piece 7*b* is provided as a part of an upper structure 12, and the upper structure 12 is joined to the cylindrical side body 6, thus assembling the magnetron. The anode cylinder 3 is joined to the input side structure 14 but not to the upper structure 12, and is cantilevered.

In this configuration, the resonance frequency and oscillation frequency of the magnetron can be adjusted by moving the position of the tuning piston 8 from outside and changing the reactance of the outer cavity 60. As a result, the oscillation frequency of the magnetron can be changed precisely, and tuned to a frequency required for an application or a device. The magnetron can oscillate high-power microwaves, and can be designed to generate high-power microwaves with the peak output of several MW and the average output of several kW.

While a high oscillation efficiency can be achieved in such an exceedingly high-power magnetron, it is important to design a cooling function for heat generated by anode dissipation. In addition, since the vanes 2 are made of a thin metal finely, when an overheat happened, there was a case where deformation was caused, thereby affecting oscillation characteristics or melting deformation was caused, thereby deteriorating the function of the magnetron. Therefore, for high-power magnetrons, there was a proposal of a design such that a coolant is run in the vicinity of an anode structure for cooling. In the case of FIG. 6, the cooling passage 11 is provided in the vicinity of the anode cylinder 3 to cool the magnetron.

JP 2004-134160 A describes a magnetron using a coolant, though it is not a coaxial magnetron, In this example, a cooling jacket is provided along the circumferential direction of the outer wall surface of an anode cylinder to which vanes are joined, and a coolant is run through the cooling jacket. This configuration enables heat generated around the vanes by anode dissipation to be exchanged with the coolant efficiently, which leads to the decrease of the temperature of the anode including the vanes.

However, as can be seen from the configurations shown in JP 10-269953 A and JP 10-302655 A, the coaxial magnetrons as shown in FIG. 6 are configured such that the outer cavity 60 is provided outside the anode cylinder 3 and the tuning piston 8 is moved up and down therein. Therefore, the configuration of the cooling jacket as described in JP 2004-134160 A cannot be adopted, and there is a problem that the magnetron cannot be cooled efficiently.

Meanwhile, in the coaxial magnetrons, the anode cylinder 3 is joined to only the input side structure 14 and is cantilevered as described above. Therefore, there was a problem that heat release to the outside from the anode cylinder 3 cannot be carried out satisfactorily. In other words, in order to strictly secure the distance between the opposing pole pieces 7*a* and 7*b*, as shown in FIG. 6, magnetrons are generally designed so that the length of the anode cylinder 3, which may be a cause of an error, is set to be rather short and only one end of the anode cylinder is joined and the other end of the anode cylinder on the side of the upper structure 12 is free. In assembling, the distance between the pole pieces 7*a* and 7*b* is adjusted to a predetermined dimension by accurately adjusting the distance La between the input side structure 14 and the upper structure 12 to a specified value and joining the upper structure 12 to the cylindrical side body 6. For this reason, the anode cylinder 3 is joined to the input side structure 14 and held in a cantilevered state and the other end of the anode cylinder on the side of the upper structure 12 is free. As a result, heat release from the anode cylinder 3 was not accelerated and thus cooling efficiency could not be improved.

In the drawings of the above-mentioned JP 10-269953 A and other references, an anode cylinder is in contact with upper and lower pole pieces. However, one end of the anode cylinder needs to be free when the distance between the pole pieces is set precisely, as described above.

To reduce heat resistance in the anode part and facilitate cooling, enlarging the cross-sectional area of the anode components such as the vanes 2 and the anode cylinder 3 can be considered. However, this affects a high frequency characteristic, and thus there is a limit in doing so. For example, there occurs a problem that the degree of coupling with the outer cavity 60 through the slot 4 becomes inadequate if the anode cylinder 3 is thickened. Therefore, the peak oscillation output generated by the magnetron is limited due to the limit of heat release of the anode part.

For the above reasons, to achieve heat release as much as possible, it is proposed that the cooling passage 11 is provided at the base of the anode cylinder 3 on the side of the input side structure 14 to run a coolant therethrough for cooling, as shown in FIG. 6, but even by this cooling, there is a limit of heat release.

SUMMARY

The presently disclosed embodiment has been made in the light of the above-mentioned problems, and an object of the presently disclosed embodiment is to provide a coaxial magnetron that can facilitate heat release from the anode part, improve an overall cooling efficiency, and enhance a peak oscillation output.

To achieve the above object, a first aspect of the coaxial magnetron of the presently disclosed embodiment comprises a cathode, an anode having an anode cylinder and vanes for forming an anode resonant cavity around the cathode, a cylindrical side body forming an outer cavity coaxial with the anode resonant cavity around the anode cylinder, a pair of end sealing structures joined to both ends of the cylindrical side body, and an input part connected to the cathode through one of the end sealing structures, wherein one end of the anode cylinder is joined to one of the end sealing structures, and the other end of the anode cylinder is joined to a groove or a step of the other of the end sealing structures, the groove or the step being formed on the inner surface of the other of the end sealing structures.

A second aspect of the coaxial magnetron of the presently disclosed embodiment comprises a cathode, an anode having an anode cylinder and vanes for forming an anode resonant cavity around the cathode, a cylindrical side body forming an outer cavity coaxial with the anode resonant cavity around the anode cylinder, a pair of end sealing structures joined to both ends of the cylindrical side body, and an input part connected to the cathode through one of the end sealing structures, wherein one end of the anode cylinder is joined to one of the end sealing structures, and the other end of the anode cylinder is joined to a gap of the other of the end sealing structures the gap being formed between a central member and an outer periphery member of the other of the end sealing structures so as to insert the anode cylinder.

In a third aspect of the presently disclosed embodiment, a passage for running a coolant therethrough is provided in the vicinity of the anode cylinder in the end sealing structure in which the input part pass through, and a passage for running a coolant therethrough is also provided in the vicinity of the anode cylinder in the end sealing structure in which the input part is not disposed.

In a fourth aspect of the presently disclosed embodiment, the central members are separated from the outer periphery members in the end sealing structures at the both ends, and the central members of the end sealing structures are joined to the outer periphery members respectively after the outer periphery members of the end sealing structures are joined to the cylindrical side body.

According to the configuration of the first aspect, for example, provided that the end sealing structures are an input side (base side) structure having an input part and an upper structure disposed on the upper side (tip side), the other end of the anode cylinder is disposed in the groove or step provided on the inner side of the upper structure, that is, there is a clearance gap between the other end (end face) of the anode cylinder and the groove or step, thereby enabling the distance between the input side structure and the upper structure to be adjusted precisely. As a result, the characteristic of the magnetron is set to a desired value. The outer periphery members of the two end sealing structures are joined to the cylindrical side body and the groove or step of the upper structure is joined to the anode cylinder, thus assembling the magnetron. At this time, the side(s) of the anode cylinder are joined to the side(s) of the groove or step of the upper structure.

According to the configuration of the second aspect, the other end of the anode cylinder is inserted into the gap formed in the upper structure, thereby enabling the distance between the input side structure and the upper structure to be adjusted precisely, and joining the sides of the anode cylinder to the sides of the gap of the upper structure. The groove or step or gap can be defined as a side space part including the side(s) and a space contacting the side(s). The side(s) of the anode cylinder are joined to the side(s) of the side space part (i.e. the side(s) of the groove, the step or the gap) provided in the upper structure.

According to the configuration of the third aspect, the cooling passages are provided in both the input side structure and the upper structure, for example, along the circumference of and in the vicinity of the anode cylinder, which enables the anode part to be cooled efficiently.

According to the configuration of the fourth aspect, before the cathode is disposed, the cylindrical side body is joined to the outer periphery members of the input side structure and the upper structure together with the anode cylinder and so on, for example, by brazing or the like, and then the central member of the input side structure to which the cathode has been fixed via an insulator is joined to the outer periphery member of the input side structure while maintaining the concentric position of the cathode to the anode cylinder. This joining is carried out by arc welding or any other method, which has less effect of temperature on the cathode (less increase in temperature), and then the central member of the upper structure is joined to the outer periphery member thereof by arc welding or the like.

The coaxial magnetron of the presently disclosed embodiment can facilitate heat release from the anode part and increase the peak oscillation output by setting the distance between the end sealing structures at both ends of the anode cylinder precisely and carrying out heat release from both ends of the anode cylinder (both upper and lower ends), even though the outer cavity for tuning is provided outside the anode resonant cavity.

According to the third aspect, cooling passages not only in one end sealing structure (input side structure) but also in the other end sealing structure (upper structure) can improve the overall cooling efficiency, while facilitating the cooling of the anode part.

According to the fourth aspect, the concentric position of the cathode to the anode cylinder can be secured well and satisfactory assembling can be carried out while the deterioration of the cathode due to heat at the time of joining is prevented.

DETAILED DESCRIPTION

Figure 1:
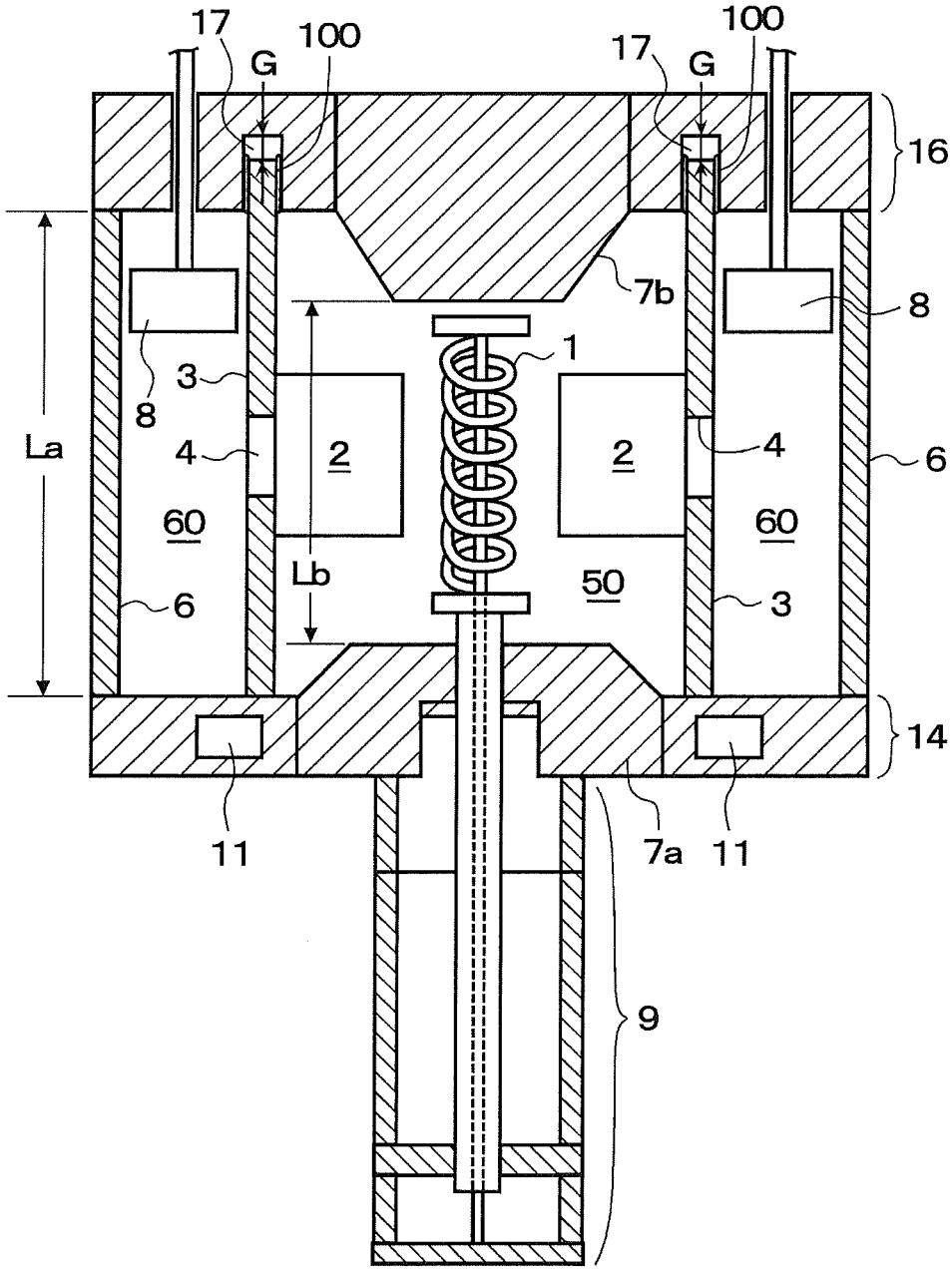
FIG. 1 is a side cross-sectional view illustrating the configuration of the coaxial magnetron in accordance with a first aspect of the presently disclosed embodiment.
Figure 6:
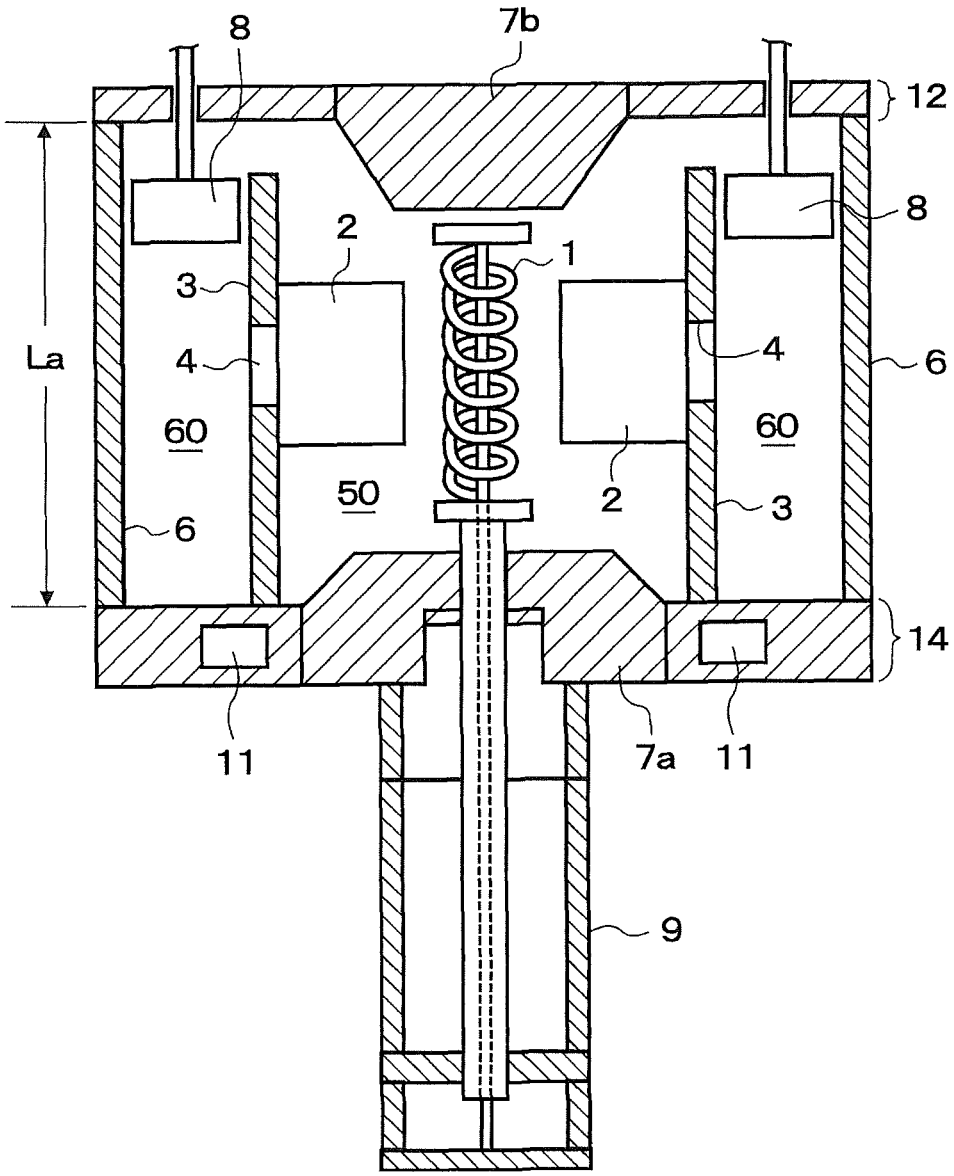
FIG. 6 is a side cross-sectional view illustrating the configuration of a conventional coaxial magnetron.

FIG. 1 shows the configuration of the coaxial magnetron in accordance with the first aspect. In the magnetron, a cathode 1 is disposed in the center thereof, and radial vanes 2 and an anode cylinder 3 to which the vanes 2 are joined are disposed as an anode around the cathode, thus forming an anode resonant cavity 50, like FIG. 6. A slot 4 is provided in the anode cylinder 3 for high-frequency coupling. Between the anode cylinder 3 and a cylindrical side body 6, an outer cavity 60 coaxial with the anode resonant cavity 50 is formed. Over and under the cathode 1, pole pieces 7*a* and 7*b* are disposed. In the outer cavity 60, tuning piston 8 is provided, and in an input side (base) structure (end sealing structure) 14 to be jointed to an input part 9, a cooling passage 11 is provided.

In the aspect, on the inner surface of an upper structure (end sealing structure) 16, an annular groove 17 for inserting the anode cylinder 3 is provided along the side of upper part of the anode cylinder 3 in a circle. As shown in FIG. 1, the groove 17 is formed so as to have a clearance gap G with the upper end face of the anode cylinder being not in contact with the bottom of the groove when the anode cylinder 3 is assembled being inserted into the groove.

In the coaxial magnetron, since the outer cavity 60 is surrounded by the input side structure 14 and the upper structure 16, a change of the distance La between the input side structure 14 and the upper structure 16 causes deviation of the resonance frequency of the outer cavity 60. Furthermore, a change of the distance Lb between the pole pieces 7*a* and 7*b* causes a decrease in the withstanding voltage of the cathode and a change of magnetic flux density distribution. Therefore, it is important to set the distances La and Lb correctly.

At the time of assembling the magnetron, the distance La between the input side structure 14 and the upper structure 16 can be adjusted well, and the La and the distance Lb between the pole pieces 7*a* and 7*b* can be maintained precisely by moving the anode cylinder 3 in the groove 17 in the direction of its cylindrical axis and setting the upper end face of the anode cylinder 3 not to come into contact with the upper structure 16 (the bottom of the groove).

The magnetron of the first aspect is assembled by joining the upper structure 16 to the input side (base) structure 14, on which the cathode 1 and the input part 9 have been mounted, through the anode cylinder 3 and the cylindrical side body 6, and the joining is carried out for example, by brazing in a high temperature furnace. That is, joining the anode cylinder 3 to the groove 17 is carried out by putting brazing filler metals therebetween and in the vicinity thereof and raising the temperature. As shown in a joint part 100 of FIG. 1, the inner and outer sides of the anode cylinder 3 are joined to both sides of the groove 17. Such brazing enables joining having low heat resistance to be achieved, and seals the magnetron (tube) to maintain the interior portion thereof under vacuum.

According to the configuration of the first aspect, joining the anode cylinder 3 to the upper structure 16 (joining having low heat resistance), which could not be carried out conventionally, can be performed, and heat release from the anode cylinder 3 to the upper structure 16 (heat release to end sealing structures at both ends) can be performed, which results in improvement of cooling efficiency.

Figure 2:
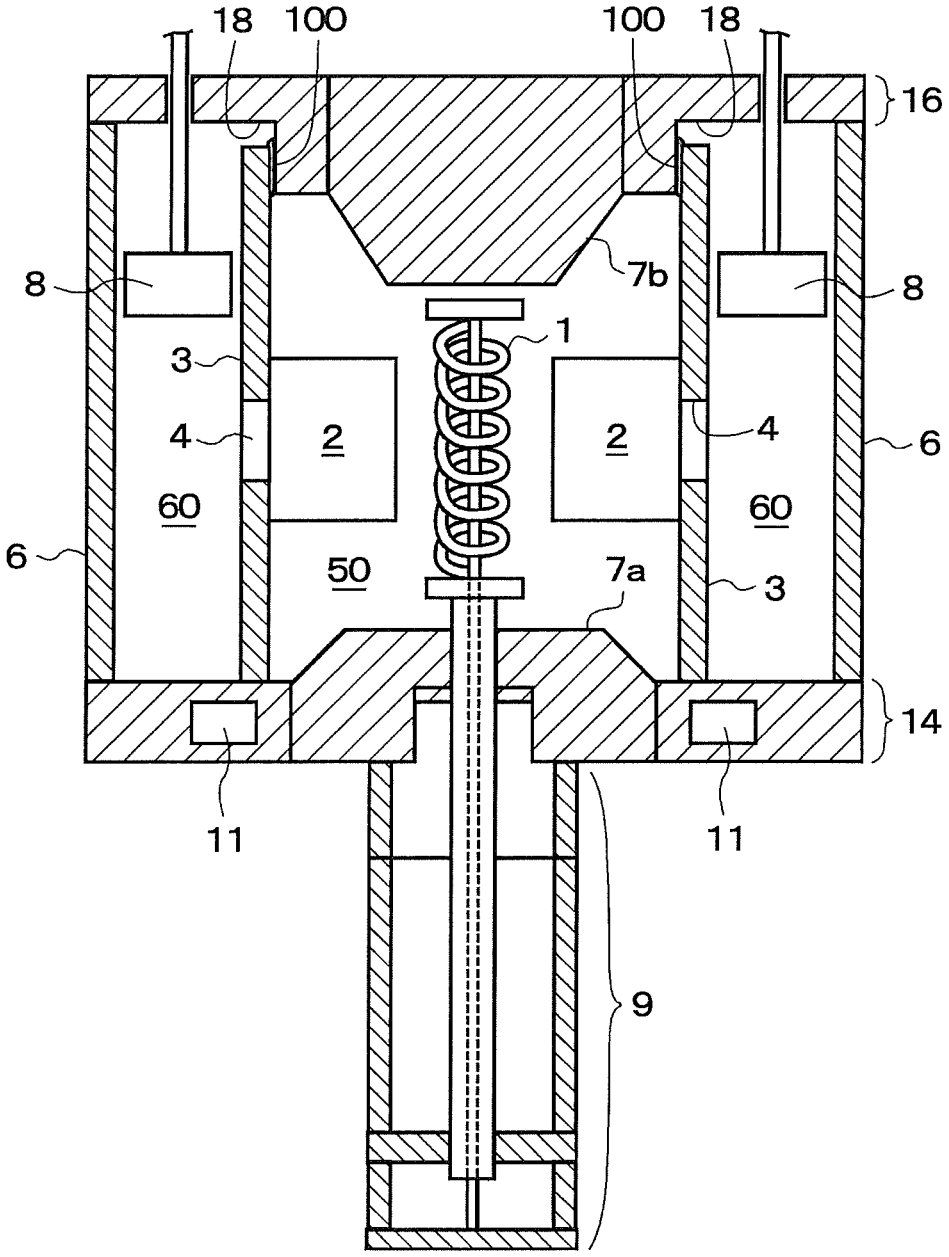
FIG. 2 is a side cross-sectional view illustrating the configuration of the coaxial magnetron in accordance with a second aspect of the presently disclosed embodiment.

FIG. 2 shows the configuration of the coaxial magnetron of the second aspect. In the second aspect, a step is provided to adjust the distance between the end sealing structures. As shown in FIG. 2, a step 18 is formed on the upper structure 16 in a circle, and (the inner surface of) the anode cylinder 3 is disposed in the vicinity of the side of the step 18. In the second aspect, the inner surface of the anode cylinder 3 is subjected to brazing and joining to the side of the step 18 as shown in a joint part 100 by putting brazing filler metals between the anode cylinder 3 and the step 18 and placing the magnetron into a furnace and raising the temperature of the furnace to a high temperature. According to the second aspect, heat is released from the anode cylinder 3 through both the input side structure 14 and the upper structure 16, which results in improvement of cooling efficiency.

Figure 3:
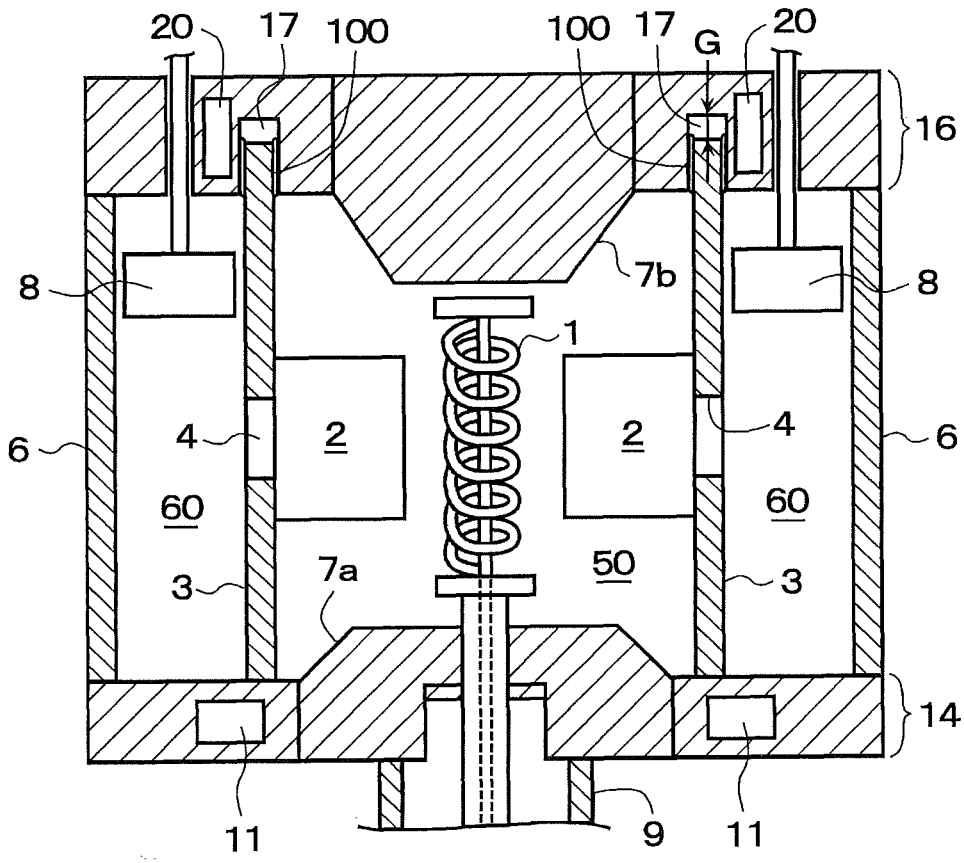
FIG. 3 is a side cross-sectional view illustrating the configuration of the coaxial magnetron in accordance with a third aspect of the presently disclosed embodiment.

FIG. 3 shows the configuration of the coaxial magnetron of the third aspect. In the third aspect, cooling passages are provided in both of the end sealing structures. As shown in FIG. 3, a cooling passage 11 is provided in the vicinity of the anode cylinder 3 in the input side structure 14 (at the base) along the side of the anode cylinder 3 in a circle, and a cooling passage 20 is also provided in the vicinity of the anode cylinder 3 in the upper structure 16 along the side of the anode cylinder 3.

According to the third aspect, heat from the anode part (vanes 2 and anode cylinder 3) or the pole pieces 7*a* and 7*b* can be reduced by running a coolant through the upper and lower cooling passages 11 and 20, which results in improvement of the overall cooling efficiency as well as cooling efficiency of the anode part. That is, since in conventional magnetrons, the upper structure 16 is not joined to the anode cylinder 3, even if a cooling passage is provided in the upper structure 16, effective cooling cannot be achieved. However, in the aspect, the anode cylinder 3 is joined to the upper structure 16 and heat generated from the vanes 2 and the anode cylinder 3 can be transferred well from the upper structure 16 to the coolant in the cooling passage 20. This effective heat transfer enables the temperatures of the vanes 2 and the anode cylinder 3 to be reduced efficiently.

In the aspect, the cooling passages 11 and 20 are provided along the side of the anode cylinder 3 in a circle, but the upper and lower cooling passages may be provided linearly or partially in the vicinity of the anode cylinder 3.

Figure 4:
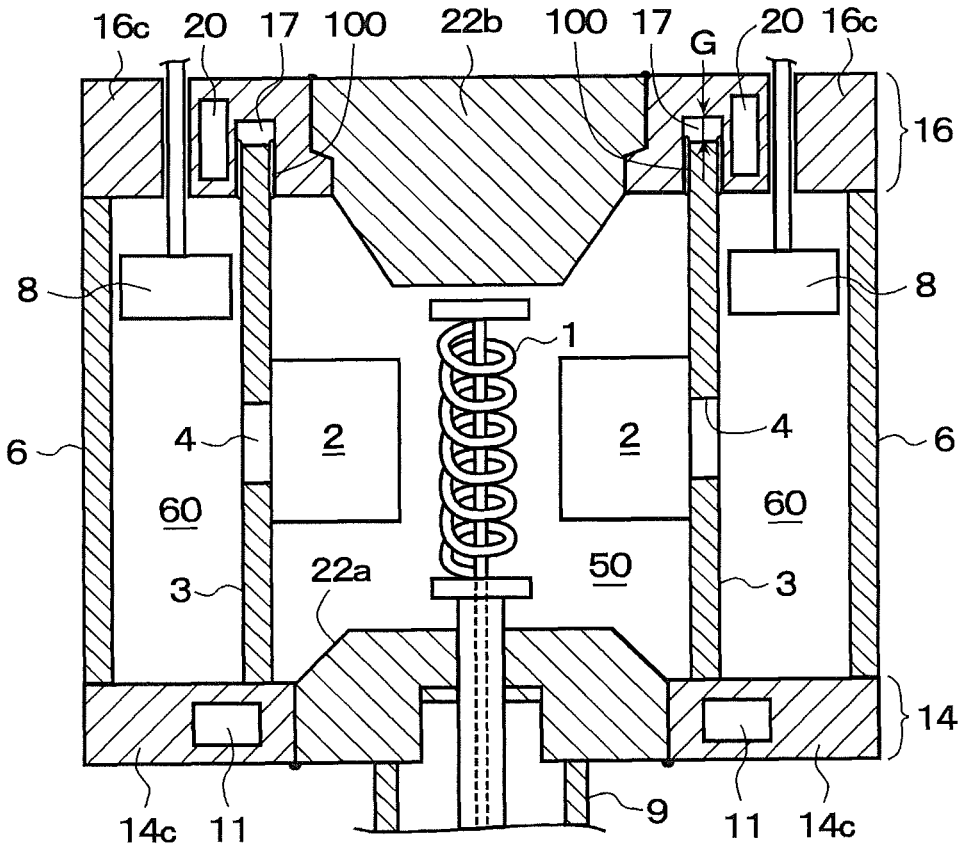
FIG. 4 is a side cross-sectional view illustrating the configuration of the coaxial magnetron in accordance with a fourth aspect of the presently disclosed embodiment.

FIG. 4 shows the configuration of the coaxial magnetron of the fourth aspect. In the fourth aspect, the central members of the end sealing structures at both ends are separated from the outer periphery members. As shown in FIG. 4, in the aspect, the pole piece (part) 22*a*, which is the central member of the input side structure 14, together with the cathode 1 and the input part 9 are separated from the outer periphery member 14*c*, and the pole piece 22*b*, which is the central member of the upper structure 16, is separated from the outer periphery member 16*c*.

In the aspect, firstly, the outer periphery member 14*c* of the input side structure 14 having the cooling passage 11 and the outer periphery member 16*c* of the upper structure 16 having the cooling passage 20 are assembled so as to cover the anode cylinder 3 and the cylindrical side body 6 and joined by brazing. Simultaneously, as described above, the upper part of the anode cylinder 3 is joined to the groove 17 by brazing (joint part 100). After that, the pole piece 22*a*, on which the cathode 1 and the input part 9 have been mounted, is inserted into the inside of the anode cylinder 3 and between the vanes 2. The pole piece 22*a* is then joined to the outer periphery member 14*c* while checking the concentric position of the cathode 1 relative to the vanes 2 from the opening of the central part of the upper structure 16 on which the pole piece 22*b* is not mounted. This joining is carried out by arc welding or other method, which has less effect of temperature on the cathode (less increase in temperature), but not by brazing. Finally, the pole piece 22*b* of the upper structure 16 is joined to the outer periphery member 16*c* by arc welding or other method similarly, and thus the magnetron that is sealed in a vacuum internally is assembled. The arc welding is a method for welding and joining by subjecting the outer surfaces of the pole piece 22*a* and the outer periphery member 14*c* to local heating and the outer surfaces of the pole piece 22*b* and the outer periphery member 16*c* to local heating.

According to the fourth aspect, the pole pieces 22*a* and 22*b* which are the central members of the end sealing structures are separated from the outer periphery members 14*c* and 16*c*, respectively and assembled later, which enables the concentric position of the cathode 1 relative to the vanes 2 to be checked. Further, deterioration of the cathode 1 can be prevented effectively since the pole pieces can be joined by a joining method such as arc welding or the like in which temperature rise is low after the outer periphery members 14*c* and 16*c* including the cooling passages 11 and 20 have been joined to the cylindrical side body 6 and the anode cylinder 3 by a joining method such as brazing or the like in which temperature rise is high and the cathode 1 has been disposed.

Figure 5:
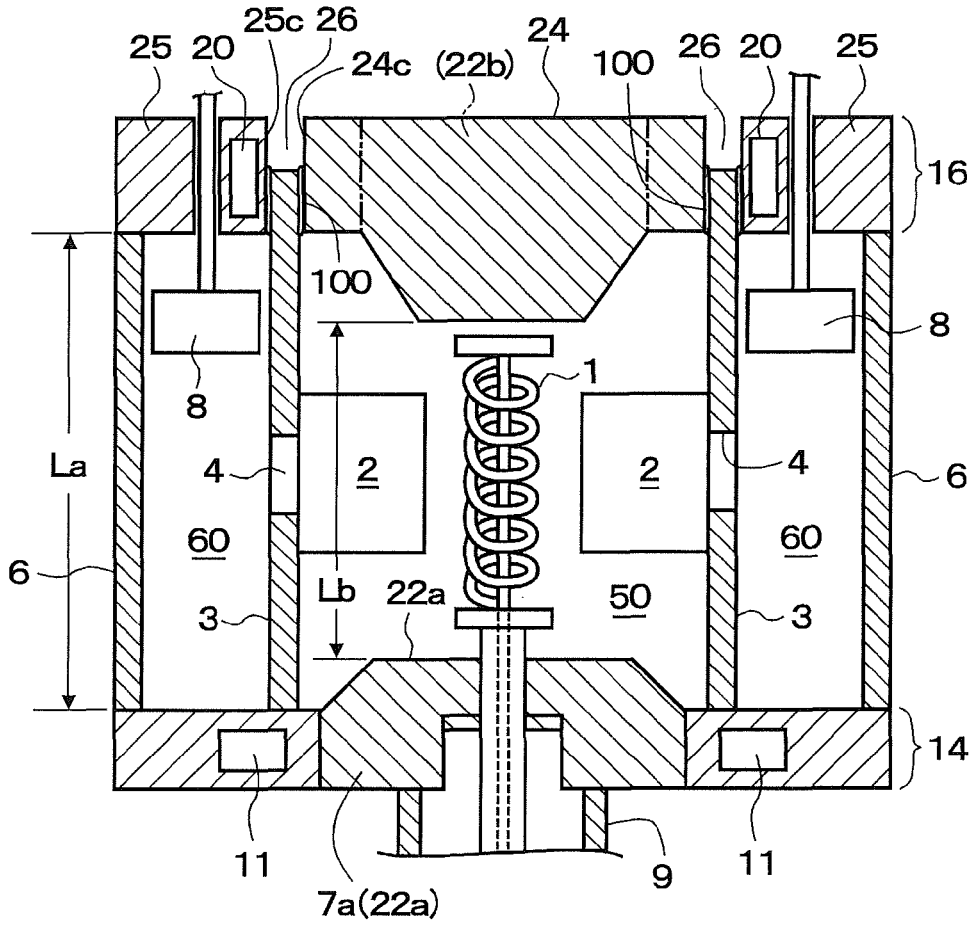
FIG. 5 is a side cross-sectional view illustrating the configuration of the coaxial magnetron in accordance with a fifth aspect of the presently disclosed embodiment.

FIG. 5 shows the configuration of the coaxial magnetron of the fifth aspect. In the fifth aspect, an gap is provided to adjust the distance between end sealing structures at both ends. As shown in FIG. 5, in the aspect, an gap 26 for enabling the anode cylinder 3 to be inserted thereinto is provided between the pole piece 24 and the outside portion 25. This gap 26 assures that the distance La between the input side structure 14 and the upper structure 16 can be adjusted well and the distance La and the distance Lb between the pole pieces 7*a* and 24 can be maintained precisely by moving the anode cylinder 3 in the direction of its cylindrical axis. The both of La and Lb can be individually adjusted to the best distance, if the gap 26 is provided and the outside portion 25 and the pole piece 24 are completely separated by gap 26. As shown in a joint part 100, the anode cylinder 3 is joined to the upper structure 16 by brazing between the inner and outer sides of the anode cylinder 3 and both sides of the gap 26 (24*c* and 25*c*). This configuration facilitates heat release from the anode cylinder 3 to the upper structure 16 and improves cooling efficiency.

Also, in the fifth aspect, the pole piece 22*a* as the central member of the input side structure 14 may be so designed as to be separated from the outer periphery member, and also the pole piece 22*b* as the central member of the upper structure 16 may be so designed as to be separated (e.g., at the part indicated by two-dot chain line) from the outer periphery member, like the fourth aspect.

The input side structure 14 and the upper structure 16 of each of the aspects are covers of the cylindrical anode, and are in a circular form along the anode cylinder 3, and thus can be processed together with the anode cylinder 3 and others at the time of processing with a lathe, which enables high work efficiency to be obtained in processing each part.

In each aspect, the groove 17 or the step 18 or the gap 26 is provided on the side of the upper structure 16, but the joining of the anode cylinder 3 to the end sealing structures at both ends may be reversed, that is, the groove 17 or the step 18 or the gap 26 may be provided on the side of the input side structure 14.

According to the coaxial magnetron of the presently disclosed embodiment, since cooling efficiency is improved, deformation and melting of the anode components mostly of the vanes 2 due to overheating at the time of generation of high output can be prevented, and such a high microwave output that has not been obtained before can be obtained. In applications and devices using microwaves such as radars and Linac, in many cases, a higher output enables a bigger effect to be obtained, and according to the presently disclosed embodiment, it is not necessary to design a larger size of magnetrons for the purposes of high cooling efficiency and high output, which has a large effect on the industries. In high-frequency coaxial magnetrons, the size of the cavity resonator is smaller depending on wavelengths, but in this case, the sizes of the anode components become smaller, and heat capacity decreases and heat resistance increases, which leads to a more disadvantageous thermal condition. However, the presently disclosed embodiment can provide an efficient cooling effect, and thus there is an advantage that high frequency coaxial magnetrons generating high output can be designed.

The presently disclosed embodiment can be applied in applications and devices using microwaves such as radars and Linac, and can also be applied in high-frequency and high-power coaxial magnetrons.

EXPLANATION OF SYMBOLS

1 Cathode
2 Vane
3 Anode cylinder
4 Slot
5 Cylindrical side body
7*a*, 7*b*, 22*a*, 22*b*, 24 Pole piece
8 Tuning piston
9 Input part
10, 14 Input side structure (end sealing structure)
11, 20 Cooling passage
12, 16 Upper structure (end sealing structure)
14*c*, 16*c* Outer periphery member
17 Groove
18 Step
25 Outside portion
26 Gap
50 Anode resonant cavity
60 Outer cavity
100 Joint part

What is claimed is:

1. A coaxial magnetron, comprising:
a cathode;
an anode having an anode cylinder and vanes for forming an anode resonant cavity around the cathode;
a cylindrical side body forming an outer cavity coaxial with the anode resonant cavity around the anode cylinder;
a pair of end sealing structures joined to both ends of the cylindrical side body; and
an input part connected to the cathode through one of the end sealing structures,
wherein one end of the anode cylinder is joined to one of the end sealing structures, and the other end of the anode cylinder is joined to a groove or a step of the other of the end sealing structures, the groove or the step being formed on the inner surface of the other of the end sealing structures and configured to adjustably receive the end of the anode cylinder in the groove or step so that interface between the anode cylinder and groove or step is selectable at joining pair of the end sealing structures to both ends of the cylindrical side body.

2. The coaxial magnetron of claim 1, wherein central members of the end sealing structures are joined to the outer periphery members respectively after the outer periphery members of the end sealing structures are joined to the cylindrical side body.

3. The coaxial magnetron of claim 1, wherein a passage for running a coolant therethrough is provided in the end sealing structure in which the input part pass through, and a passage for running a coolant therethrough is also provided in the end sealing structure in which the input part is not disposed.

4. The coaxial magnetron of claim 3, wherein central members of the end sealing structures are joined to the outer periphery members respectively after the outer periphery members of the end sealing structures are joined to the cylindrical side body.

5. A coaxial magnetron, comprising:

a cathode;

an anode having an anode cylinder and vanes for forming an anode resonant cavity around the cathode;

a cylindrical side body forming an outer cavity coaxial with the anode resonant cavity around the anode cylinder;

a pair of end sealing structures joined to both ends of the cylindrical side body; and an input part connected to the cathode through one of the end sealing structures, wherein one end of the anode cylinder is joined to one of the end sealing structures, and the other end of the anode cylinder is joined to a gap of the other of the end sealing structures, the gap being formed between a central member and an outer periphery member of the other of the end sealing structures so as to insert the anode cylinder and configured to adjustably receive the end of the anode cylinder gap so that interface between anode cylinder and the gap is selectable at joining the pair of the pair of the end sealing structures to both ends of cylindrical side body.

6. The coaxial magnetron of claim 5, wherein central members of the end sealing structures are joined to the outer periphery members respectively after the outer periphery members of the end sealing structures are joined to the cylindrical side body.

7. The coaxial magnetron of claim 5, wherein a passage for running a coolant therethrough is provided in the end sealing structure in which the input part pass through, and a passage for running a coolant therethrough is also provided in the end sealing structure in which the input part is not disposed.

8. The coaxial magnetron of claim 7, wherein central members of the end sealing structures are joined to the outer periphery members respectively after the outer periphery members of the end sealing structures are joined to the cylindrical side body.

* * * * *